US005238059A

United States Patent [19]

Smith

[11] Patent Number: 5,238,059

[45] Date of Patent: Aug. 24, 1993

[54] HEAT EXCHANGER HEADER WITH PARALLEL EDGES

[75] Inventor: David M. Smith, Niagara Falls, N.Y.

[73] Assignee: General Motors Corporation, Detroit, Mich.

[21] Appl. No.: 891,114

[22] Filed: Jun. 1, 1992

[51] Int. Cl.[5] ..... F28F 9/02

[52] U.S. Cl. ..... 165/173; 165/153

[58] Field of Search ..... 165/153, 173

[56] References Cited

U.S. PATENT DOCUMENTS

| | | | |
|---|---|---|---|
| 4,938,284 | 7/1990 | Howells | 165/149 |
| 4,971,145 | 11/1990 | Lyon | 165/173 |
| 5,036,914 | 8/1991 | Nishishita et al. | 165/173 |
| 5,062,476 | 11/1991 | Ryan et al. | 165/173 |
| 5,107,926 | 4/1992 | Calleson | 165/173 |
| 5,127,466 | 7/1992 | Ando | 165/67 |

*Primary Examiner*—Allen J. Flanigan
*Attorney, Agent, or Firm*—Patrick M. Griffin

[57] ABSTRACT

A heat exchanger includes two parallel tank units forming a fluid space therein, and supporting a core therebetween. The core includes parallel tube passes connected between the tank units, and air centers connected between the tube passes for conductive heat exchange with air flowing therethrough. The header includes tube slots therein for receiving the ends of the tube passes in fluid communication with the fluid space. The tank units are comprised of a separate header and tank. The tank is formed of a U-shaped extrusion with grooves formed in the opposing arms thereof. The header is arcuately shaped and includes side edges parallel to one another to be received within the grooves for connecting the header to the tank.

2 Claims, 2 Drawing Sheets

HEAT EXCHANGER HEADER WITH PARALLEL EDGES

TECHNICAL FIELD

The invention relates to a heat exchanger apparatus and a method of forming a heat exchanger of the type for a motor vehicle, more specifically the heat exchanger is of the type including parallel tube passes between a pair of tank units and further including air centers between the tube passes for directing the inlet air stream of the vehicle through tube passes in the heat exchanger and wherein the tank units are formed by a separate header and tank which require clinching to one another during brazing thereof.

BACKGROUND OF THE INVENTION

Motor vehicle heat exchangers for cooling engine coolant, refrigerant vapor and transmission oil in vehicles are known. Commonly, these types of heat exchangers include a pair of tank units and a plurality of parallel tube passes extending between the tank units. Air centers are connected between the parallel tube passes. Many of these heat exchangers utilize separate headers and tanks braze sealed to one another.

U.S. Pat. No. 5,062,476 issued Nov. 5, 1991 in the name of Ryan et al. and assigned to the assignee of the subject invention discloses a typical heat exchanger utilizing a pair of tank units with a parallel tube pass core therebetween. The tank units are comprised of separate headers and tanks which are braze sealed to one another. The header comprises a generally flat elongated sheet slid into grooves within the tank.

U.S. Pat. No. 5,036,914 issued Aug. 6, 1991 in the name of Nishishita et al. discloses a heat exchanger of a similar type discussed above including the separate tanks and headers with a parallel tube pass core therebetween. The tank comprises a generally arcuate shape having transverse flanges extending therefrom. The header is generally semicircular in shape and includes an exterior surface which abuts the tank flanges. A problem with this type of design is that the header and tank are not clinched to one another and may separate during assembly of the tube passes thereto such that a braze seal therebetween is faulty.

SUMMARY OF THE INVENTION

The invention includes a heat exchanger apparatus of the type having a pair of tank units supporting a core therebetween. The core comprises a plurality of parallel tube passes with air centers. The tube passes extend between the tank units in fluid communication therewith. The core conductively exchanging heat with air flowing therethrough. The apparatus comprises a pair of tank units each forming a fluid space therein. Each of the tank units includes a separate header and tank member secured to one another forming the fluid space therebetween. The tank member includes opposing arms having an interior and exterior surface. The interior surface forms the fluid space. The header comprises a substantially arcuate die form having arcuate interior and exterior surfaces extending between longitudinal edge walls. The edge walls are parallel to one another to abut against the interior surface of the tank member for maintaining the header against the tank member.

The invention also includes the provision of interior surfaces on the opposing arms defining grooves having a flat base formed therein. The longitudinal edge walls abut against the flat base of the grooves for maintaining the header against the tank member. Additionally, the flat bases formed in the tank are parallel to the exterior surface. The header includes tube slots formed therein for receiving the tube passes in fluid communication with the fluid space. Wells are formed in the arcuate extrusion about tube slots and are of arcuate configuration.

BRIEF DESCRIPTION OF THE DRAWINGS

Advantages of the subject invention will become readily appreciated as the same becomes better understood when taken in conjunction with the accompanying drawings wherein.

DETAILED DESCRIPTION OF THE PREFERRED EMBODIMENT

Figure 1:
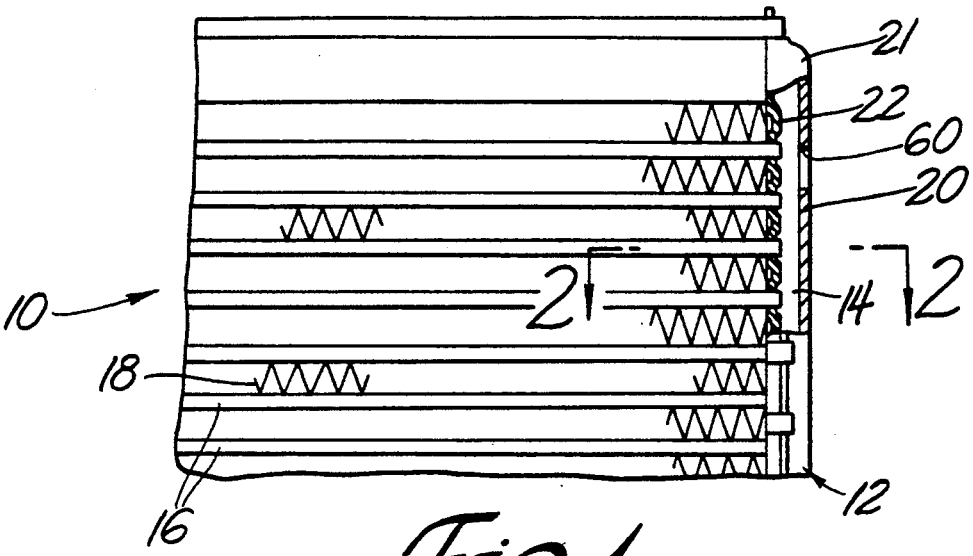
FIG. 1 is an enlarged partially broken away, front elevational view of the heat exchanger of the subject invention.

A heat exchanger 10 of the subject invention is generally illustrated in FIG. 1. The heat exchanger 10 includes a pair of tank units 12 (one shown) having a fluid space 14 therein for containing engine or refrigerant fluid. In the preferred embodiment, the heat exchanger is utilized as a condenser for a vehicle of the type having a cooling HVAC (heating, ventilating, and air conditioning) system. However, it is to be understood that the heat exchanger described herein may be used as other types of heat exchangers or in other types of environments.

The heat exchanger 10 also includes a plurality of parallel tube passes 16 extending between the pair of tanks 12 in fluid communication with the fluid space 14. Air centers 18 are connected between the tube passes 16 for directing the inlet air stream of the vehicle through the tube passes to conductively cool the fluid in the case that the fluid is refrigerant flow through a condenser. The air centers 18 are comprised of a thin metal strip convoluted along its length to form an extended surface for exchange of heat between air flow across the air centers 18.

Figure 2:
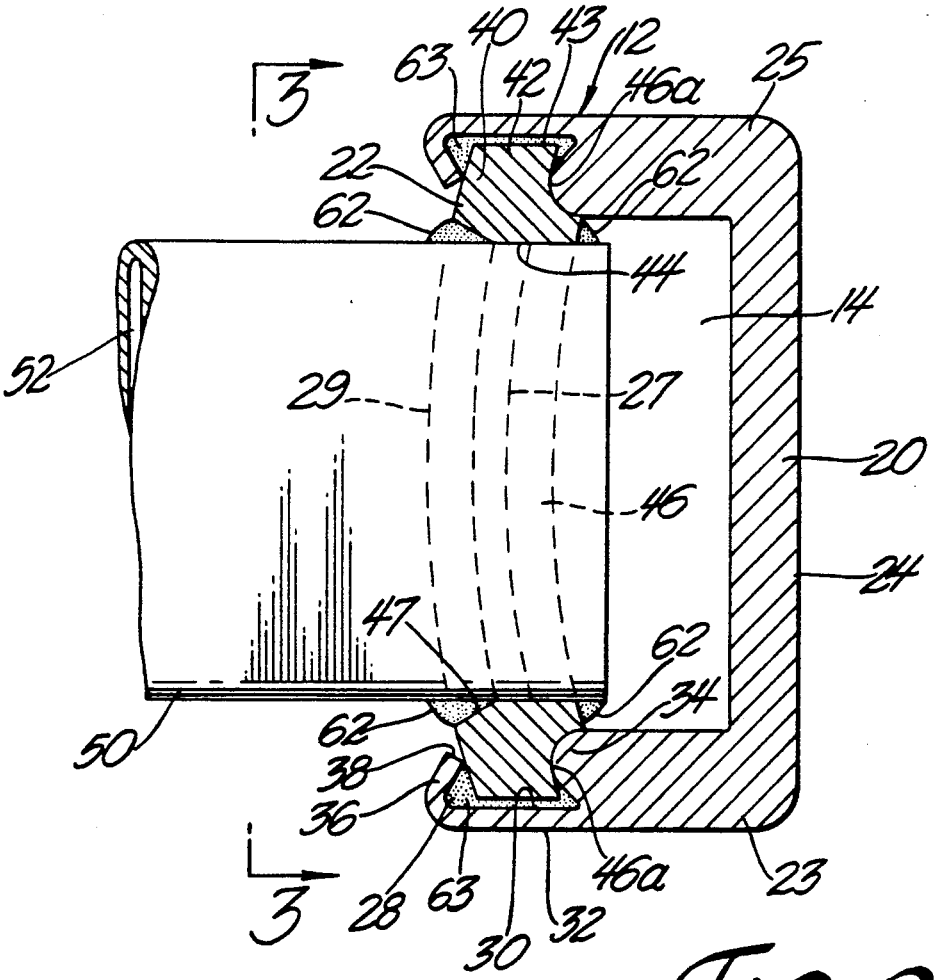
FIG. 2 is an enlarged, fragmentary cross-sectional view taken along lines 2—2 of FIG. 1.
Figure 3:
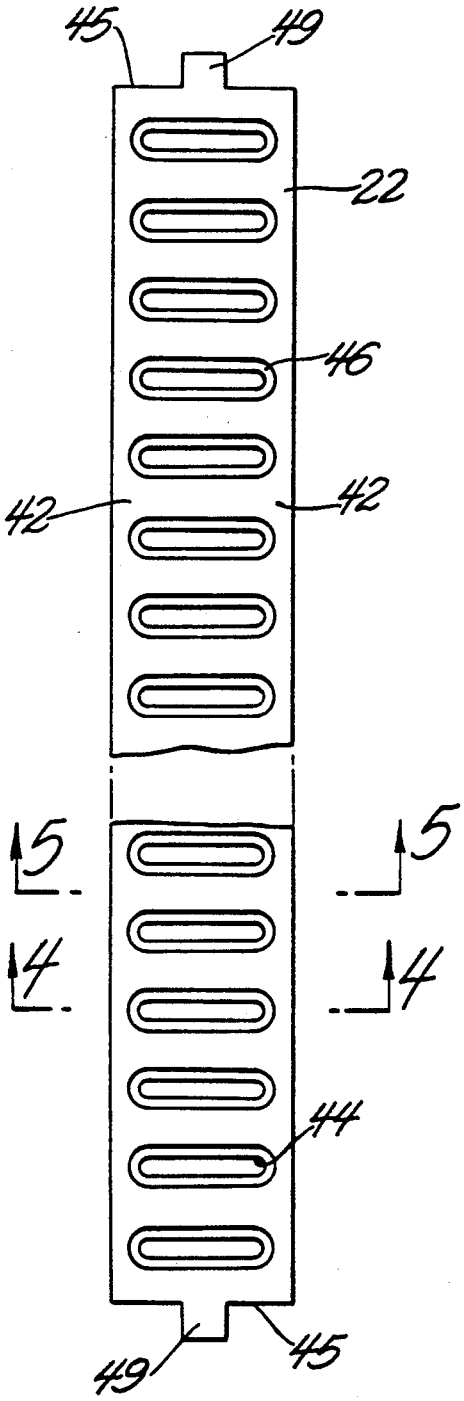
FIG. 3 is an enlarged front elevational view of the header taken along lines 3—3 of FIG. 2.
Figure 4:
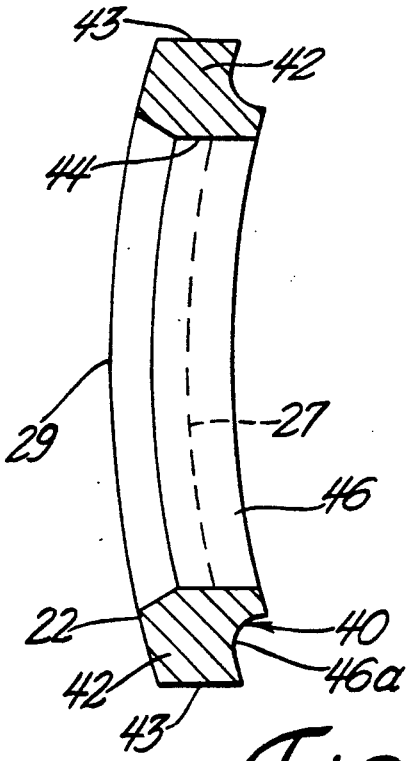
FIG. 4 is a cross-sectional view of the header taken along lines 4—4 of FIG. 3.
Figure 5:
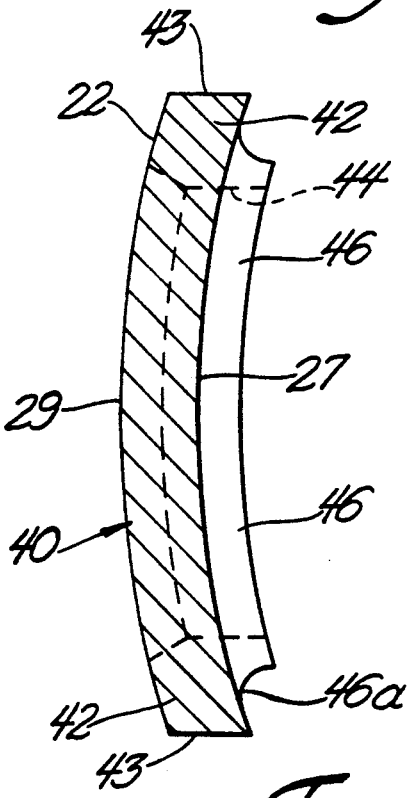
FIG. 5 is a cross-sectional view of the header taken along lines 5—5 of FIG. 3.

As best illustrated in FIG. 2, each tank unit 12 comprises a unitary extruded tank 20 and separate header 22 providing the fluid space 14 therebetween. The extruded tank 20 forms three longitudinally directed walls 23, 24, 25. The three walls 23, 24, 25 are generally flat sided, with the opposing first 23 and third 25 walls parallel to each other and perpendicular to the second wall 24. The opposing side walls 23, 25 have formed on the interior surfaces 26, channels or grooves 28 extending longitudinally the length of the tank units 12. The grooves 28 include a flat base 30 parallel with the outer surface 32 of the walls 23, 25, and having a thickness less than the thickness of the remainder of the walls 23, 25, i.e. one-fourth the thickness. The base 30 meets the remainder of the walls 23, 25 at a bowed wall or curved protrusion 34 extending into the groove 28, the function which will be discussed subsequently. Opposing the protrusion 34 across the groove 28 is a clinch arm 36 inclined from the base 30 toward the groove 28 to hold the header 22 in place. The protrusion 34 and arm 36 cause the width of the base 30 to be greater than the distance between the protrusion 34 and the bent edge 38 of the clinch arm 36.

The header 22 is formed from a generally arcuate sheet stock which is die formed 40 having longitudinal side flanges 42. The radius of curvature of the header 22 has its center on the interior or tank 20 side. The header 22 also includes a plurality of tube slots 44 formed therein and spaced longitudinally along the length of the tank units 12. The tube slots 44 may be formed by piercing the header wall 22 with a punch or die. Such punching may be as in manner as commonly known in the art for forming openings in sheet metal. The tube slots 30 are elongated transverse to the longitudinal axis through the tank unit 12 to receive the ends of the tube passes 16.

The header 22 also includes a plurality of dimples or wells 46 formed therein at and about each tube slot 44. The wells 46 project inwardly toward the fluid space 14. The wells 46 provide strengthening of the header 22 and tube passes 16. Furthermore, the slots 44 are graduated to provide inclined surfaces 47 allowing lead in of the tube passes 16. The curvature of the protrusion 34 complements the curvature of the edge of the wells 46 at surfaces **46*a*** thereof.

The side flanges 42 of the header 22 form a perimeter about the header 22. The wells 46 extend between the side flanges 42, but not into the side flanges 42 themselves to allow the side flanges 42 to provide uniform, smooth surfaces for sealing. The flanges 42 continue the generally arcuate shape. The side flanges 42 include flat edge walls 43 which are parallel to one another and perpendicular to a vertical plane through the arcuate header 22. In other words, the arcuate header 22 is formed between two arcuate, interior and exterior surfaces 27, 29 wherein the edge walls 43 are formed between the surfaces 27, 29 and are parallel to one another. The edge walls 43 extend between a thickness of the header 22 provided between the surfaces 27, 29. The die formed header 22 may be formed of a rectangular roll formed sheet material, thereafter bowed or arcuately formed. Thereafter, the side flanges 42 are cut such that the flanges 42 have edge walls 43 that are parallel to one another and perpendicular to a vertical plane through the header 22 as viewed in FIG. 2.

The upper and lower longitudinal ends 45 of the header 22 include tabs 49 extending therefrom adapted to mechanically lock into upper and lower reinforcements for better alignment of parts during assembly. The ends of the tank 20 may be formed to meet and abut against the header 22. Alternatively, end caps (not shown) as commonly known in the art may be inserted to seal the fluid in the fluid space 14.

Upon assembly, the header 22 is connected to the tank 20 by sliding the side flanges 42 into the grooves 28. The side flanges 42 are clinched between the protrusion 34 and the clinch arm 36 at the bent end 38. The flange edge walls 43 are parallel to the bases 30 of the grooves 28 and abut thereagainst, and are therefore also parallel to the opposing side walls 23, 25. The flange edge walls 43 provide a line of contact for sealing with the flat bases 30. Furthermore, the curvature of the protrusion 34 mates with the well's curvature at surfaces **46*a*** providing reinforcement and additional sealing contact surfaces.

The extruded tank 20 and header 22 are formed of a suitable aluminum alloy material, such as 3003 aluminum alloy. The material of the extrusions are only illustratively included herein with it being understood that other extrudable materials are contemplated within the invention as set forth in the appended claims. Cladding material is roll bonded on the surfaces of header 22 to allow braze sealing between the header 22 and the tank 20 and the tube passes 16 during brazing thereof to provide sealed joints 62, 63.

The tube passes 16 are comprised of flat sided extruded tubes 50 having fluid flow passages 52 extending therethrough between first and second open ends. The tube extrusions 50 may have a plurality of flow paths or a single flow path therethrough, as commonly known in the art. The extruded tubes 50 may be extruded from a material similar to that of the tank 12.

The tanks 12 include apertures 60 (one shown) therein for receiving inlet and outlet pipe fittings in the side walls 24 thereof to communicate either coolant hoses or refrigerant hoses with the fluid space. Such fitting are commonly known in the art. Both the inlet and outlet apertures 60 and fittings are located on the same tank 12 in the case of an even number of passes of the fluid through the tube passes 16, such as two passes. The inlet and outlet apertures 60 and fittings are connected on opposite tanks 12 in the case of an odd number of passes system, such as a single pass system. In the case of multiple pass systems, a divider or partition may be inserted within the tank and are of clad material, as commonly known in the art. The assembly 10 is thereafter brazed to seal the clad joints.

The invention includes a method of making a heat exchanger which includes the steps of directing an extrudable material through an extruding die, shaping the extruding die to form the elongated U-shaped tank 20 having grooves in opposing sidewalls 23, 25, die forming an arcuate header 22, cutting the side edges of the header to form parallel edge walls 43, piercing a plurality of tube slots in the header, sliding the header into the grooves of the tank. Thereafter, the plurality of tubes lengths are cut and inserted into the tube slots. The system is brazed to seal the joined parts.

Condensers 10 require a high burst pressure. The header 22 has an arcuate shape or radius of curvature that helps retain its shape under high pressure. As the radius of curvature decreases, i.e. greater arc, header displacement or deformation decreases. Furthermore, the parallel edge walls 43 allow assembly of the header 22 to the tank 20 while maintaining the tube slots 44 square to receive the tube passes 16.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise tan as specifically described.

What is claimed is:

1. A heat exchanger, comprising:

a pair of fluid tank units supporting a plurality of parallel tube passes extending in fluid communication therebetween;

each of said tank units having a separate tank member and header secured to one another to form said tank unit, said tank member having parallel walls including grooves at the base of each of which is formed a protrusion that is curved in cross section and which runs the length of each respective groove, said header having an arcuate interior surface including perimeter side flanges that fit into said grooves and against said curved protrusions, said header also having a plurality of slots and surrounding wells through which the ends of said tube passes are receivable, the edges of said wells terminating short of said side flanges and having a curvature that blends into the arcuate shape of said side flanges as well as complementing the cross sectional curvature of said protrusions, whereby, when said tank member and header are secured, said protrusions, side flange interior surfaces, and well edges mate together so as to provide complete sealing contact and reinforcement for said securement.

2. A heat exchanger, comprising:

a pair of fluid tank units supporting a plurality of parallel tube passes extending in fluid communication therebetween, each of said tank units having a separate tank member and header secured to one another to form said tank unit, said tank member having parallel walls including grooves at the base of each of which is formed a protrusion that is curved in cross section and which runs the length of each respective groove, said tank members further including a bendable clinch arm having a thin edge opposed to each protrusion, said header having an arcuate exterior surface and an arcuate interior surface including perimeter side flanges that fit into said grooves and against said curved protrusions, said header also having a plurality of slots and surrounding wells through which the ends of said tube passes are receivable, the edges of said wells terminating short of said side flanges and having a curvature that blends into the arcuate shape of said side flanges as well as complementing the cross sectional curvature of said protrusions, whereby, said tank member and header may be secured by engaging said protrusions and side flanges and bending said clinch arm edges over into engagement with said header exterior surfaces, so that said protrusions, side flange interior surfaces, and well edges mate together to provide complete sealing contact and reinforcement for said securement.

* * * * *